US008145094B2

(12) United States Patent
Takemoto

(10) Patent No.: US 8,145,094 B2
(45) Date of Patent: Mar. 27, 2012

(54) FRAME AND IMAGE FORMING APPARATUS USING THE FRAME

(75) Inventor: Hideyuki Takemoto, Chigasaki (JP)

(73) Assignee: Ricoh Company, Ltd., Tokyo (JP)

( * ) Notice: Subject to any disclaimer, the term of this patent is extended or adjusted under 35 U.S.C. 154(b) by 375 days.

(21) Appl. No.: 12/385,990

(22) Filed: Apr. 27, 2009

(65) Prior Publication Data

US 2009/0274484 A1 Nov. 5, 2009

(30) Foreign Application Priority Data

Apr. 30, 2008 (JP) ..... 2008-118054

(51) Int. Cl.
*G03G 15/00* (2006.01)

(52) U.S. Cl. ..... 399/107; 312/351.4; 361/724

(58) Field of Classification Search ..... 399/107, 399/108, 110; 312/223.2, 351.4, 351.5, 351.7, 312/351.8; 174/559, 560, 561; 361/679.01, 361/724, 727

See application file for complete search history.

(56) References Cited

U.S. PATENT DOCUMENTS

| | | | | |
|---|---|---|---|---|
| 5,949,924 | A | 9/1999 | Noguchi et al. | |
| 6,023,538 | A | 2/2000 | Noguchi et al. | |
| 6,078,703 | A | 6/2000 | Noguchi et al. | |
| 6,122,412 | A | 9/2000 | Noguchi et al. | |
| 6,167,221 | A * | 12/2000 | Kobayashi | 399/107 |
| 6,259,872 | B1 * | 7/2001 | Fukunaga et al. | 399/107 |
| 6,466,753 | B2 * | 10/2002 | Kida | 399/107 |
| 6,546,228 | B2 | 4/2003 | Motohashi et al. | |
| 6,636,338 | B1 * | 10/2003 | Kida et al. | 359/196.1 |
| 6,678,487 | B2 * | 1/2004 | Tashiro et al. | 399/107 |
| 6,690,901 | B2 | 2/2004 | Katsuyama et al. | |
| 6,930,886 | B2 * | 8/2005 | Velez et al. | 361/727 |
| 7,177,573 | B2 | 2/2007 | Kimura et al. | |
| 7,274,893 | B2 * | 9/2007 | Morimoto et al. | 399/107 |
| 7,302,204 | B2 | 11/2007 | Katsuyama et al. | |

FOREIGN PATENT DOCUMENTS

| | | | |
|---|---|---|---|
| CN | 101870101 A | * | 10/2010 |
| EP | 2 109 013 | | 10/2009 |
| JP | 10-026854 | | 1/1998 |
| JP | 10-310267 | | 11/1998 |
| JP | 11-017865 | | 1/1999 |
| JP | 11017865 A | * | 1/1999 |
| JP | 2000-082881 | | 3/2000 |
| JP | 3439301 | | 6/2003 |
| JP | 2007093744 A | * | 4/2007 |

OTHER PUBLICATIONS

European Search Report dated Jan. 26, 2010.
Abstract of JP 10-026854 published Jan. 27, 1998.

* cited by examiner

*Primary Examiner* — Robert Beatty
(74) *Attorney, Agent, or Firm* — Harness, Dickey & Pierce, P.L.C.

(57) ABSTRACT

A frame for an image forming apparatus including at least one functional unit includes a front member, a rear member, a base member, and a pair of elevated supporters. The front and rear members at least support the functional unit. The base member supports at least the rear member. The pair of elevated supporters, fixed at least to the base member, have a U-shaped form in its cross-section. The elevated supporters are spaced a given distance apart and disposed facing an open part of the U-shaped form of the pair of elevated supporters. The elevated supporters supports both lateral rim portions of the front member at a given position of the pair of elevated supporters. The front member is indirectly fixed with the base member via the elevated supporters, and positions the functional unit at a given position.

13 Claims, 13 Drawing Sheets

FRAME AND IMAGE FORMING APPARATUS USING THE FRAME

CROSS-REFERENCE TO RELATED APPLICATIONS

This application claims priority under 35 U.S.C. 119(a) to Japanese Patent Application No. 2008-118054, filed on Apr. 30, 2008 in the Japan Patent Office, the entire contents of which are hereby incorporated by reference herein.

BACKGROUND OF THE INVENTION

1. Field of the Invention

The present disclosure generally relates to a frame of an image forming apparatus such as a copier, a printer, a facsimile machine, or the like, and an image forming apparatus using the frame.

2. Description of the Background Art

Typically, image forming apparatuses employ a frame to define the apparatus, allow access to the interior of the apparatus, and support functional units inside the apparatus at precise positions within the apparatus, wherein the functional units may include an image forming unit but not limited to thereto. The frame supports the functional units either by direct contact or indirectly.

Ideally, the image forming apparatus is installed on a flat or level surface to reduce strain on or distortion of the frame of the apparatus. However, for various reasons, some image forming apparatuses may be installed on a surface that is not flat or level, which may strain or distort the frame of the apparatus. Such strain on or distortion of the frame may cause strain on or distortion of the image forming unit supported by the frame, which in turn may result in image quality deterioration. For example, the image quality deterioration may be appears as: two parallel lines in an image may be undesirably produced as unparallel lines; a straight line in an image may be undesirably produced as curved line; a right angle in an image may be undesirably deviated from the right angle; and two color images may not be superimposed one on another correctly.

Placing the image forming apparatus on a surface that is not level affects not only the quality of imaging. For example, typically, for ease of operation and servicing, image forming apparatuses are physically accessible both externally and internally from a front side of the apparatus, so that an operation panel can be operated, or replaceable units can be easily installed in and removed from the apparatus. Accordingly, some units that are not inspected or checked on a daily basis may be disposed at a rear side of apparatus. For example, a driving unit, a power unit or the like may be disposed at the rear side of apparatus, and thus not easily accessible by a user.

A further complication is that, to reduce a footprint of the image forming apparatus, such units disposed at the rear side of apparatus may be projected rearward outside of the footprint of apparatus. Consequently, some image forming apparatuses may have a center of gravity at a rearward of the apparatus relative to a physical center of the apparatus.

When an image forming apparatus having a center of gravity at its rearward portion is installed on an uneven surface, the image forming apparatus may be unstable. For example, the rear side of apparatus may land firmly on the floor but the front side of apparatus may not land firmly on the floor; one of a right and left side of front portion of apparatus may not land firmly on the floor; and a frame in the front side of apparatus may more likely deform. Consequently, strain or distortion may be more likely to occur at the front side of the frame of image forming apparatus. To reduce such strain or distortion, stiffness of frame may need to be enhanced at the front side of the image forming apparatus so as to attain good level of shape retentiveness of the frame.

JP-3439301-B discloses an image forming apparatus having an image forming unit, a sheet feed unit disposed under the image forming unit, a front plate, a rear plate, and a base plate. The front plate and rear plate are fixed on a front and a rear of the base plate. Accordingly, the image forming unit and the sheet feed unit may be disposed in a space defined by the front and rear plates. In such a frame, the front plate may not have a good level of stiffness because some open space is required for withdrawing a sheet cassette from the sheet feed unit. Such image forming apparatus may further include an image scanning unit over the image forming unit. Specifically, one or more support pillars may be fixed on top rim portions of the front plate and extended in an upward direction to support the image scanning unit. The support pillars can be used to reduce strain or distortion of the image scanning unit disposed over the image forming unit. But the support pillars may not be extended to the base plate or a portion supporting the sheet feed unit. Accordingly, such configuration may not effectively enhance stiffness of the frame at the front side. Consequently, strain on or distortion of the image forming unit may occur due to a lack of stiffness of the frame.

JP-H10-310267-A discloses an image forming apparatus including a frame, an image forming unit, and a sheet feed unit, in which the frame supports the image forming unit, and the sheet feed unit is disposed under the image forming unit. The frame may include a front plate and a rear plate, support pillars, and a base plate to which the support pillars are fixed. The image forming unit may be supported by one front plate and one rear plate, and the sheet feed unit may be supported by another front plate and another rear plate. The front plate and the rear plate are supported by the support pillars fixed on the base plate. Each of the support pillars may have a hollow structure, which means the support pillar may have a hollow cross-section.

In such frame, the support pillars, which support the front and rear plates, are fixed on the base plate, by which stiffness of the frame may be enhanced. Further, because one set of front and rear plates are provided for the image forming unit and another set of front and rear plates are provided for the sheet feed unit, strain on or distortion of the sheet feed unit may not cause strain on or distortion of the image forming unit.

In JP-3439301-B, the frame may not have the requisite shape retentiveness. Further, the front plate, supporting the image forming unit disposed over the sheet feed unit, is extended and fixed on the base plate, which is placed under the sheet feed unit. Accordingly, a size of front plate becomes greater relative to a size of the image forming unit. A greater front plate may have a lower precision on its physical dimensions, and may increase manufacturing cost, die or molding cost, and delivery cost, by which cost reduction may be hard to attain.

In JP-H10-310267-A, the frame may have a good level of shape retentiveness. However, the front plate is supported and positioned at a given plane of the support pillars, having the hollow square shape, parallel to the front plate. Such configuration may not position the front plate at a given position precisely. Further, hollow supports need a welding process for closing a gap of support pillar. Further, the support pillar may need a welding process and a joint member for fixing the support pillars, by which a manufacturing cost may increase compared to a support pillar having a U-shaped form. Further, such frame may need a plurality of front and rear plates, by which cost reduction may be hard to attain.

SUMMARY

In one aspect of the invention, a frame for an image forming apparatus including at least one functional unit includes a front member, a rear member, a base member, and a pair of elevated supporters. The front and rear members at least support the functional unit. The base member supports at least the rear member. The pair of elevated supporters, fixed at least to the base member, have a U-shaped form in its cross-section. The elevated supporters are spaced a given distance apart and disposed facing an open part of the U-shaped form of the pair of elevated supporters. The elevated supporters supports both lateral rim portions of the front member at a given position of the pair of elevated supporters. The front member is indirectly fixed with the base member via the elevated supporters, and positions the functional unit at a given position.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
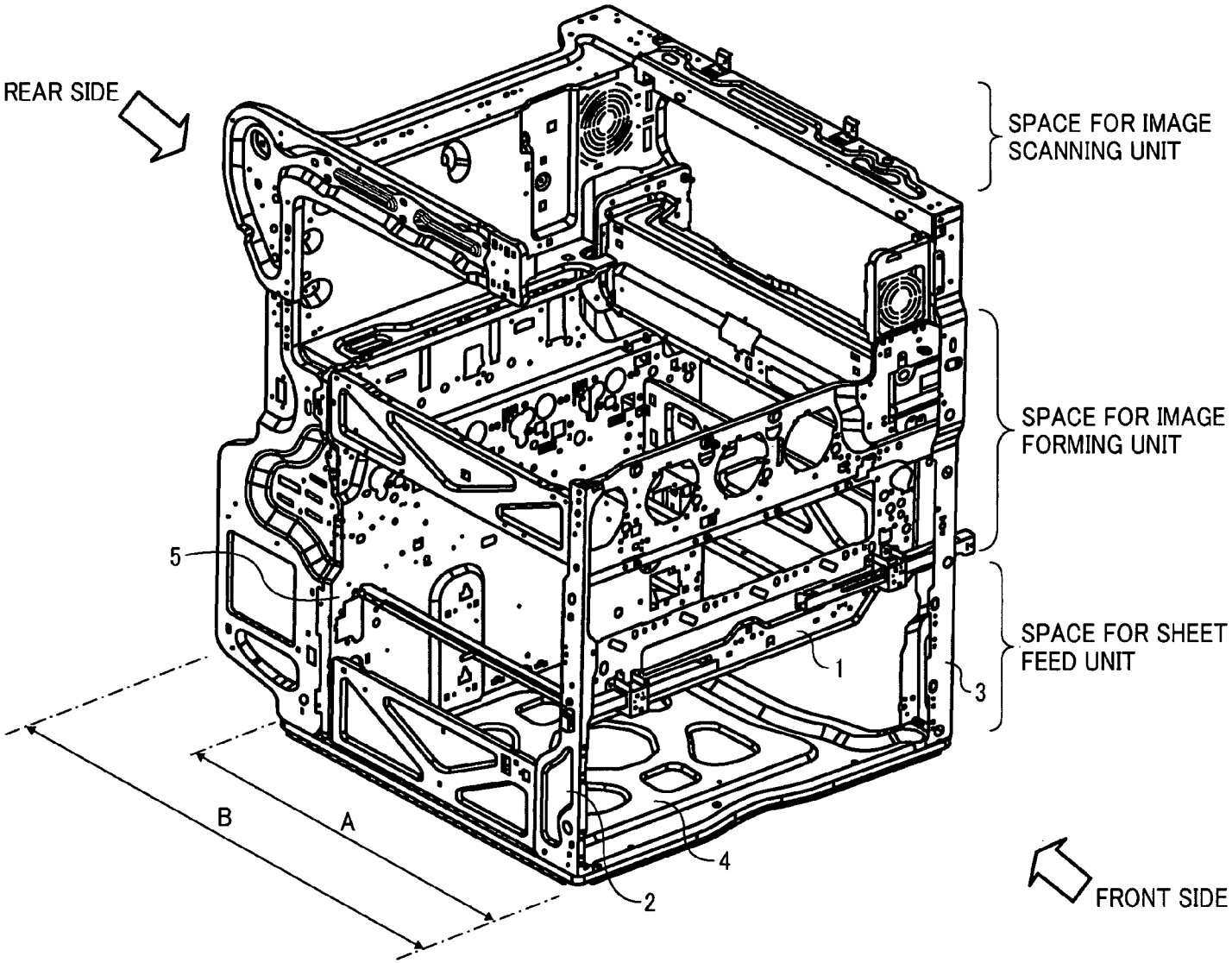
FIG. 1 illustrates a schematic perspective view of a frame according to an example embodiment, used in an image forming apparatus.

The accompanying drawings are intended to depict example embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXAMPLE EMBODIMENTS

A description is now given of example embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region; layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing expanded views shown in the drawings, specific terminology is employed for the sake of clarity, the present disclosure is not limited to the specific terminology so selected and it is to be understood that each specific element includes all technical equivalents that operate in a similar manner.

Referring now to the drawings, an image forming apparatus including a frame according to an example embodiment is described. The image forming apparatus may employ electrophotography, for example, and may be used as a copier, a printer, a facsimile, or a multi-functional imaging apparatus, but not limited thereto.

FIG. 1 illustrates a schematic perspective view of a frame of an image forming apparatus according to an example embodiment, in which the frame may support functional units or the like disposed in the image forming apparatus at a given position precisely. The frame may include a front member 1, a rear member 5, a first elevated supporter 2, a second elevated supporter 3, and a base member 4, for example. The base member 4 may have a span B (arrow B in FIG. 1) in a front-to-rear side direction, which may be longer than a span A (arrow A in FIG. 1) for the front member 1 and the rear member 5. Such frame may define and retain the structure of apparatus and support functional units, such as for example an image forming unit, disposed between the front member 1 and the rear member 5. Hereinafter, the functional unit may be referred to the image forming unit as a representative of functional unit, but the functional unit may not be limited thereto. The image forming unit may include a plurality of sub-units such as for example a scan unit, a writing unit, a power control unit, a transfer unit, a registration unit, and a fixing unit. Accordingly, the frame may precisely support such sub-units in the image forming unit at a given position directly or indirectly.

The rear member 5 may be landed and fixed on the base member 4 in a direction perpendicular to the base member 4. Further, the first elevated supporter 2 and the second elevated supporter 3 may be landed and fixed on the base member 4 in a direction perpendicular to the base member 4 while precisely positioned on the base member 4. The first elevated supporter 2 and the second elevated supporter 3 can support the front member 1 while positioning both lateral rim portions of the front member 1 at a given position of the first elevated supporter 2 and the second elevated supporter 3 precisely. With such a configuration, the image forming unit can be positioned at a given position in the image forming apparatus precisely. As shown in FIG. 1, the front member 1 may not support a sheet feed unit, and may not land on the base member 4.

Figure 2:
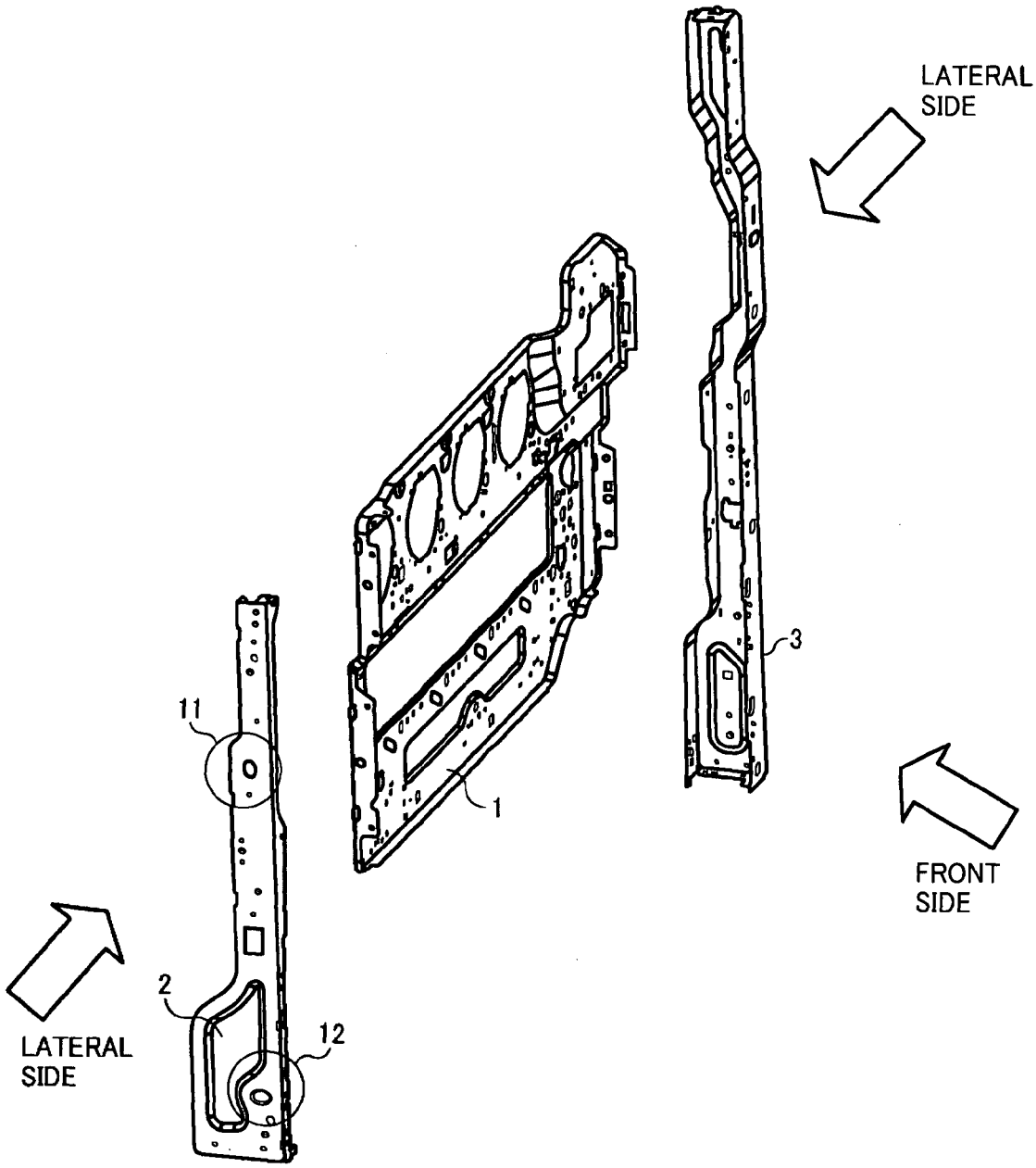
FIG. 2 illustrates an exploded view of a front plate and an elevated supporter of the frame.
Figure 3:
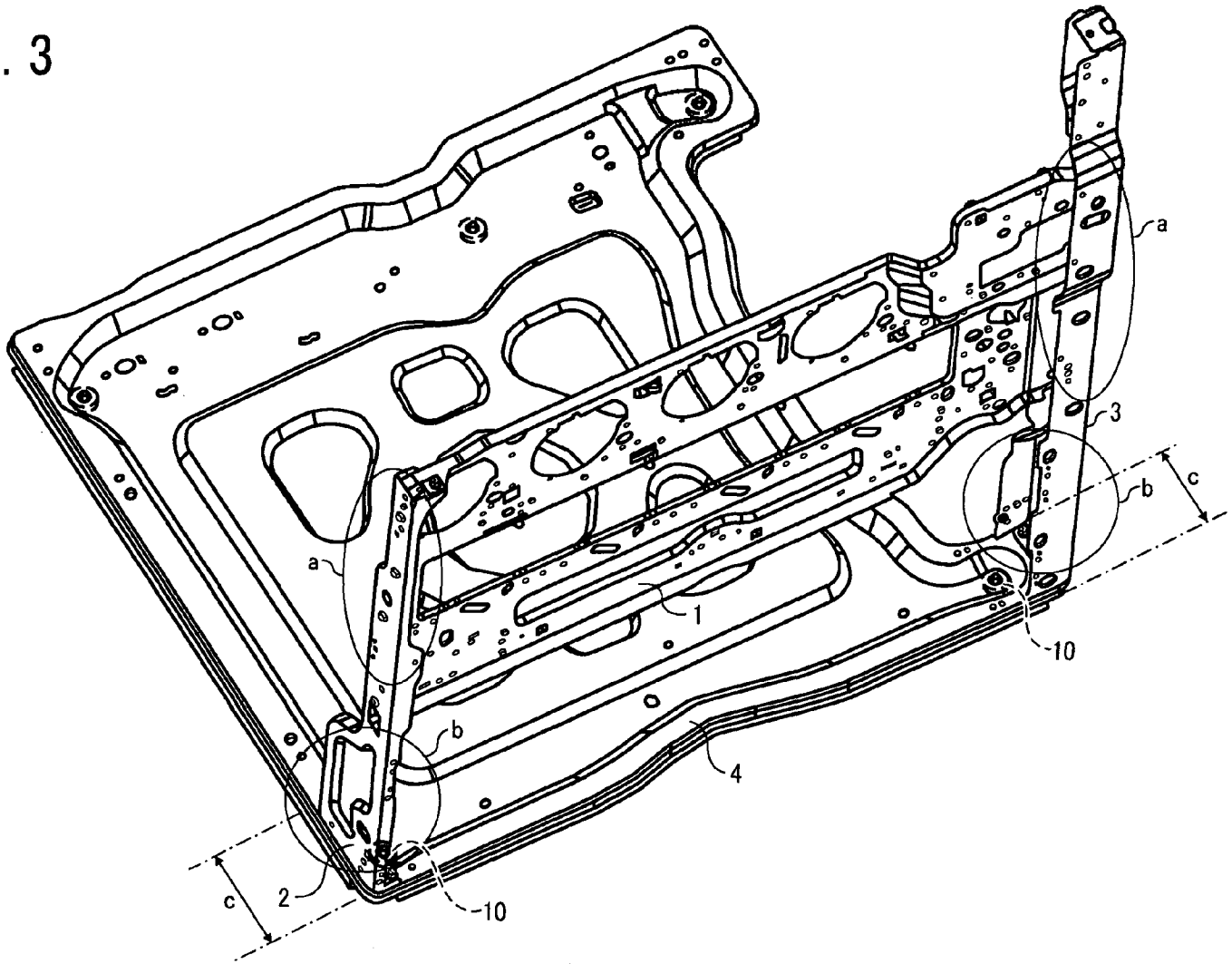
FIG. 3 illustrates a schematic perspective view of the front plate fixed to a base frame via the elevated supporter.

FIG. 2 illustrates an exploded view of the front member 1, and the elevated supporters 2 and 3. FIG. 3 illustrates a schematic perspective view of the front member 1, the elevated supporters 2 and 3, and the base member 4 fixed together. Specifically, the elevated supporters 2 and 3 may be fixed to the base member 4, and the elevated supporters 2 and 3 may support the both lateral rim portions of the front member 1. Such configuration may enhance stiffness of the front member 1 compared to a configuration fixing the front member 1 to the base member 4 directly. Accordingly, the shape retentiveness of the frame can be enhanced, by which the strain or distortion of the frame, which may likely occur at the front side of apparatus when the apparatus is installed on a surface that is not flat or level, can be reduced, and each of units supported directly and indirectly by the frame can be positioned precisely.

The front member 1, the rear member 5 and the base member 4 may be formed in given shapes, which may be suitable for configuring a specific apparatus. For example, the front member 1, the rear member 5 and the base member 4 may be substantially formed in a plate-like shape, but not limited thereto.

Figure 4:
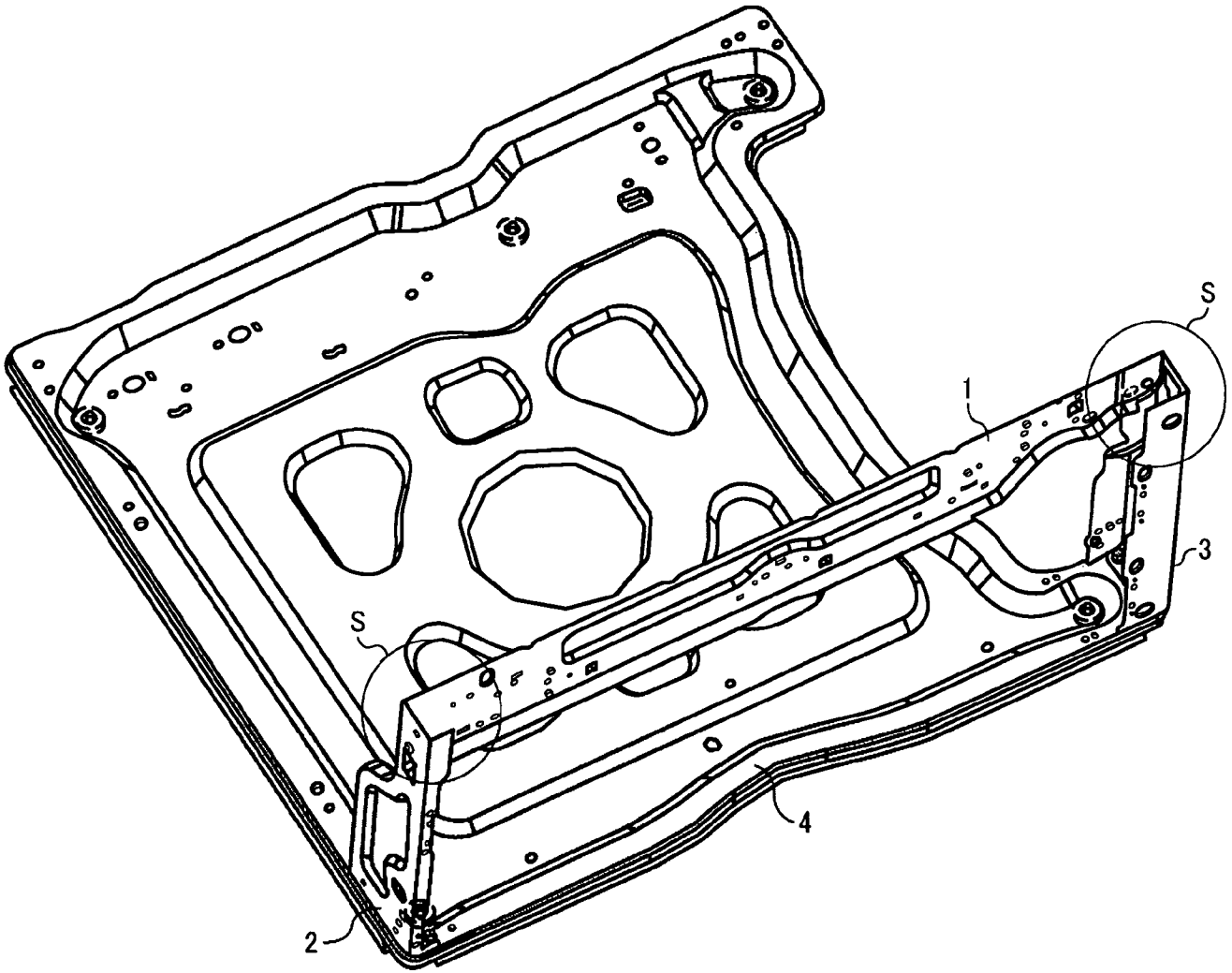
FIG. 4 illustrates a cross sectional view of a fixed condition of the front frame and the elevated supporters at a lower portion of the front frame.

FIG. 4 illustrates a cross sectional-view of a fixed condition of the front member 1 and the elevated supporters 2 and 3 at a lower portion of the front member 1. As shown in FIG. 4, the elevated supporters 2 and 3 may have a U-shape form as its cross-sectional shape (see circle S in FIG. 4). The elevated supporters 2 and 3 may face each other by facing an open portion of the U-shape each other. The U-shape form may take a substantially U-shape structure. For example, the U-shape form may be composed of three-side plates bended each other with a right angle, or composed of one plates curved or bended with a certain degree, but not limited thereto.

By using such elevated supporters 2 and 3, an rim portion of the front member 1 can be abutted against and fixed to a first internal face, which is disposed inside the U-shaped form of the elevated supporters 2 and 3 parallel to a transversal direction of the front member 1, and another rim portion of the front member 1 can be abutted against and fixed to a second internal face inside the U-shaped, which is perpendicular to the first internal face, by which the front member 1 can be positioned at a given position precisely.

On the contrary, if the elevated supporters 2 and 3 may not face each other by facing an open portion of the U-shape each other, or if such elevated supporters may have a hollow square shape in its cross section, the front member 1 can be abutted against and fixed only to an outer face of elevated supporter from one direction. Such configuration may not position the front member 1 at a given position precisely.

Accordingly, in an exemplary embodiment, the elevated supporters 2 and 3 can be used as support members supporting the image forming unit, and can be also used as precise positioning members which can position the image forming unit at a given position precisely. Specifically, the elevated supporters 2 and 3 can support and position the front member 1 using the first internal face and the second internal face of the elevated supporters 2 and 3, wherein the first internal face may be an internal rear face, and the second internal face may be lateral face, which may be perpendicular to the internal rear face, for example.

Further, the front member 1 may be indirectly fixed with the base member 4 via the elevated supporters 2 and 3, which means that the front member 1 is not extended and directly fixed to the base member 4. Accordingly, the front member 1 can be reduced in size while enhancing stiffness of the front member 1. Further, because the front member 1 can be reduced in size, part-dimension precision for the front member 1 can be enhanced, and a cost reduction can be achieved. Further, the rim portion of the front member 1, which may have a sharp form, may not be exposed outside at a portion connected to the elevated supporters 2 and 3, by which safety (e.g., injury-free) of the front member 1 may be attained. If the sharp rim portion may be exposed outside, such portion may cause harm when a user or other person touches it.

Further, an elevated supporter having a hollow square shape may need a welding process for closing a gap of the elevated supporter, and the elevated supporter having the hollow square shape may further need a welding process and a joint member to fix the elevated supporter to another frame. On the contrary, the elevated supporters 2 and 3 having the U-shaped form can be manufactured without such welding process for gap closing and a welding process and a joint member required for fixing the elevated supporter to another frame. Accordingly, the elevated supporters 2 and 3 can achieve cost reduction.

Further, the elevated supporters 2 and 3 having the U-shaped form can be manufactured with less restriction on a machining process compared to an elevated supporter having a hollow square shape. Specifically, the elevated supporters 2 and 3 can be formed in various forms such as for example a straight form, and a curved-portion included form using a drawing process. Accordingly, variety of layout designs can be devised for the frame, which is desirable for enhancing freedom of layout designs.

Figure 5:
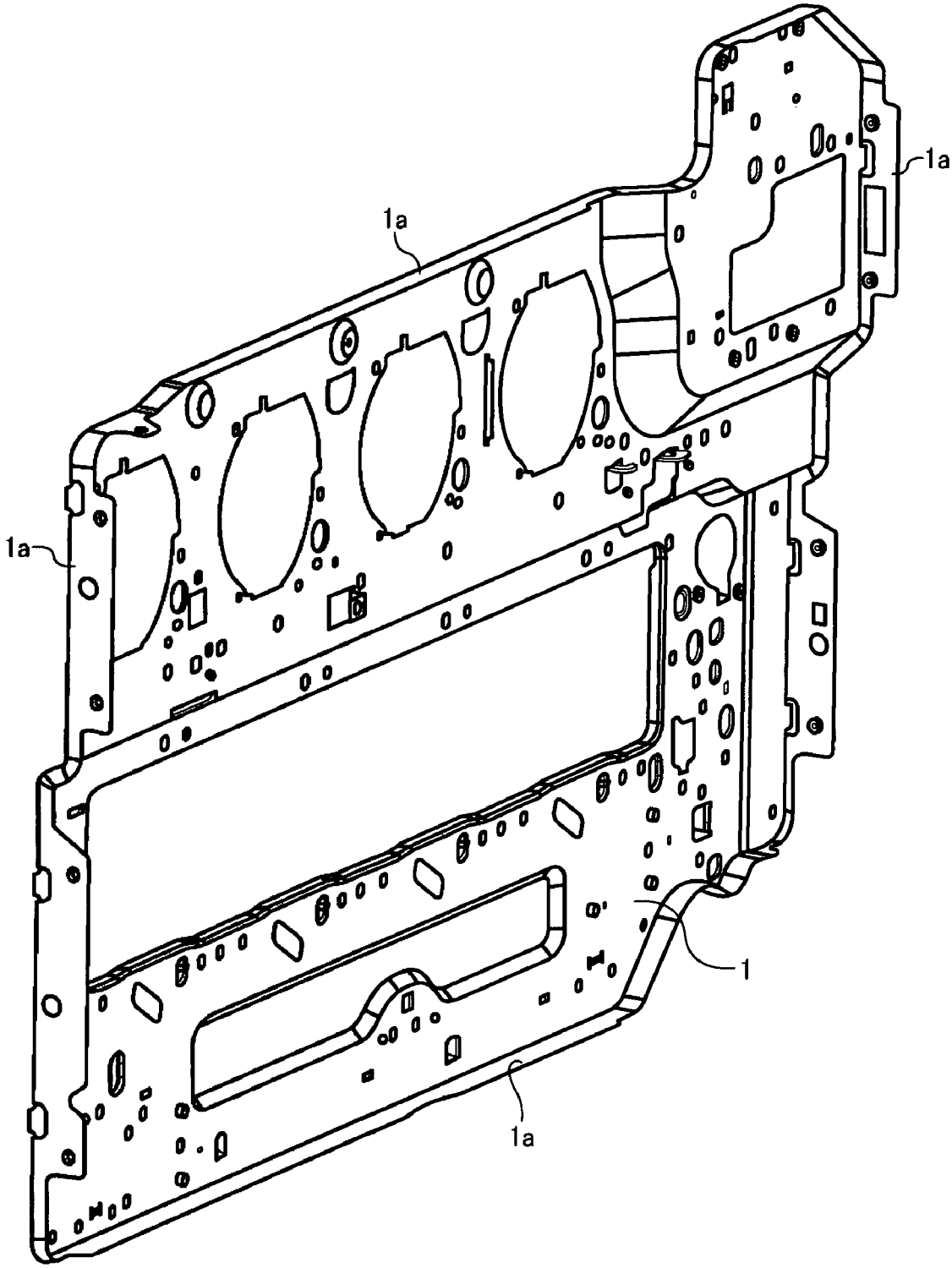
FIG. 5 illustrates a schematic perspective view of the front plate including a flange.

FIG. 5 illustrates a schematic perspective view of the front member 1. The front member 1 may include a flange 1*a* formed along a circumference of the front member 1 to enhance stiffness of the front member 1. As shown in FIG. 5, the flange 1*a* may be preferably formed extendedly along the circumference of the front member 1 to enhance stiffness of the front member 1. Although FIG. 5 shows that the flange 1*a* extends along an entire circumference of the front member 1, the flange 1*a* may not need to be formed along the entire circumference of the front member 1.

Figure 6:
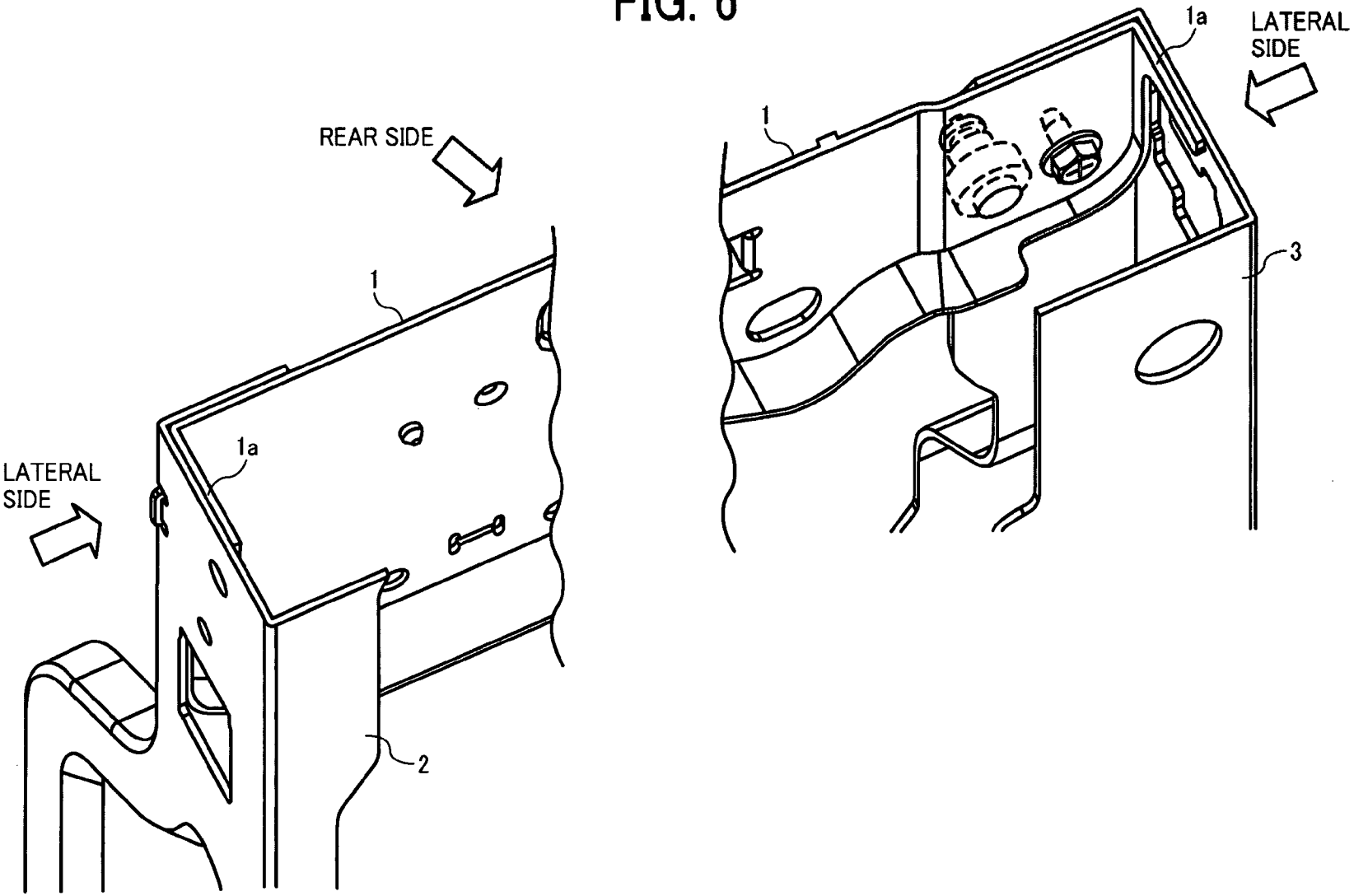
FIG. 6 illustrates an expanded view of a cross sectional view of a fixed portion of the front plate and the elevated supporter.

FIG. 6 illustrates an expanded view of a fixed portion of the front member 1 and the elevated supporters 2 and 3. As shown in FIG. 6, the front member 1 may be fixed to the elevated supporters 2 and 3 from two directions. For example, the elevated supporters 2 and 3 can support the front member 1 from the rear side direction and the lateral side direction as shown in FIG. 6. Specifically, lateral faces of the elevated supporters 2 and 3 may be fixed to a lateral portion of the flange 1*a* of the front member 1. Accordingly, the front member 1 and the elevated supporters 2 and 3 can be assembled and integrated as a substantially one single structure, by which stiffness of the frame can be further enhanced.

Further, the elevated supporters 2 and 3 having the U-shaped form can encase the front member 1 in a portion of the U-shaped form as shown in FIG. 6. Accordingly, the flange 1*a* extending along the circumference of the front member 1 may not need to be cut in a middle of the flange 1*a*, by which enhanced stiffness of the frame can be maintained.

Further, as shown in FIG. 3, the elevated supporters 2 and 3 may be formed to have different physical dimensions along the elevated supporters 2 and 3. For example, an lower portion "b" of the elevated supporters 2 and 3 near which the elevated supporters 2 and 3 are fixed to the base member 4, may be set greater than an upper portion "a" of the elevated supporters 2 and 3 near which the elevated supporters 2 and 3 are fixed with the front member 1. Accordingly, the lower portion "b" may have a greater cross-sectional area than the upper portion "a."

Accordingly, a lower part of the elevated supporters 2 and 3 may have a greater stiffness compared to an upper part of the elevated supporters 2 and 3, by which the stiffness at the front side of the frame and the stiffness of the whole frame can be effectively attained.

Figure 7:
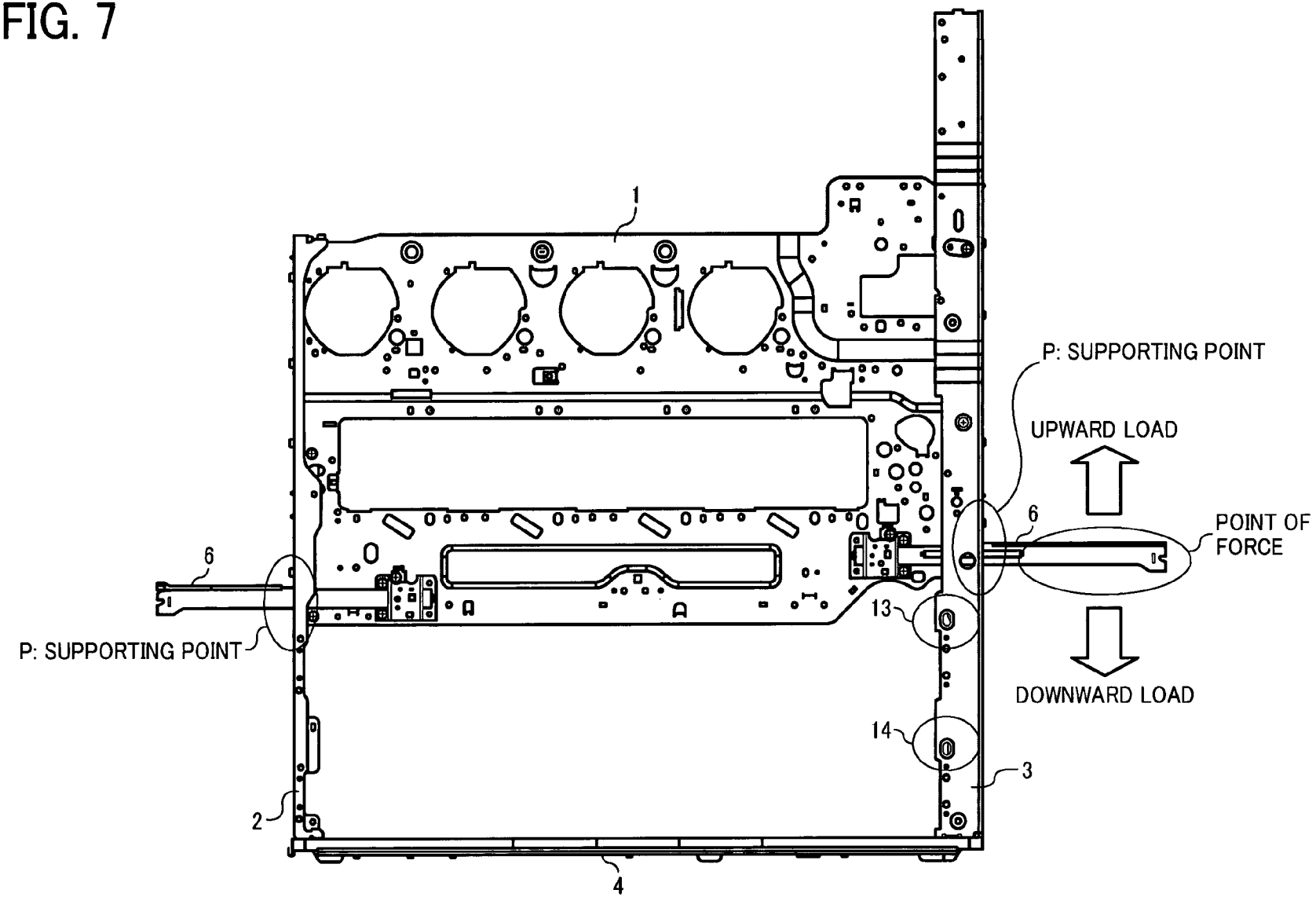
FIG. 7 illustrates a front view of the frame, in which an arm is withdrawn.

Further, the frame may include an arm 6, which can be pulled out from the frame when to move or transport the apparatus from one place to another. FIG. 7 illustrates a front view of the frame, in which the arm 6 can be pulled out from a lateral side of the elevated supporters 2 and 3 when to use the arm 6.

The arm 6 is disposed in the frame in a given configuration so that a given portion P (see FIG. 7) of the elevated supporters 2 and 3 can be used as a supporting point of the arm 6 when the arm 6 is pulled out and the apparatus is lifted by applying an upward load to a grip portion of the arm 6 (a point of force). Similarly, the given portion P (see FIG. 7) of the elevated supporters 2 and 3 can be used as the supporting point of the arm 6 when the arm 6 is pulled out and a downward load is applied to the point of force. As such, the load applied to the supporting point of the arm 6 can be received by a given portion of the elevated supporters 2 and 3 by which the arm 6 can be used safely even if some given load is applied to the arm 6. Such load may be applied to a given direction for the elevated supporters 2 and 3 (e.g., shear direction).

A description is now given to the elevated supporters 2 and 3 used as the precise positioning member for positioning unit(s) precisely as above described. Such elevated supporters 2 and 3 can position given parts or units at a given position precisely, in which the elevated supporters 2 and 3 may contact the given parts or units directly.

A description is now given to a configuration for positioning an exterior cover precisely at a given position of lateral face of the elevated supporters 2 and 3. As shown in FIG. 2, a lateral face of the first elevated supporter 2 may be provided with positioning holes 11 and 12, wherein the first elevated supporter 2 may be precisely positioned in the frame as above described. The positioning holes 11 and 12 may be engaged with positioning members projected from a lateral face of the exterior cover, by which the exterior cover can be precisely positioned at a given position relative to the frame, by which an external appearance of image forming apparatus can be enhanced.

Figure 8:
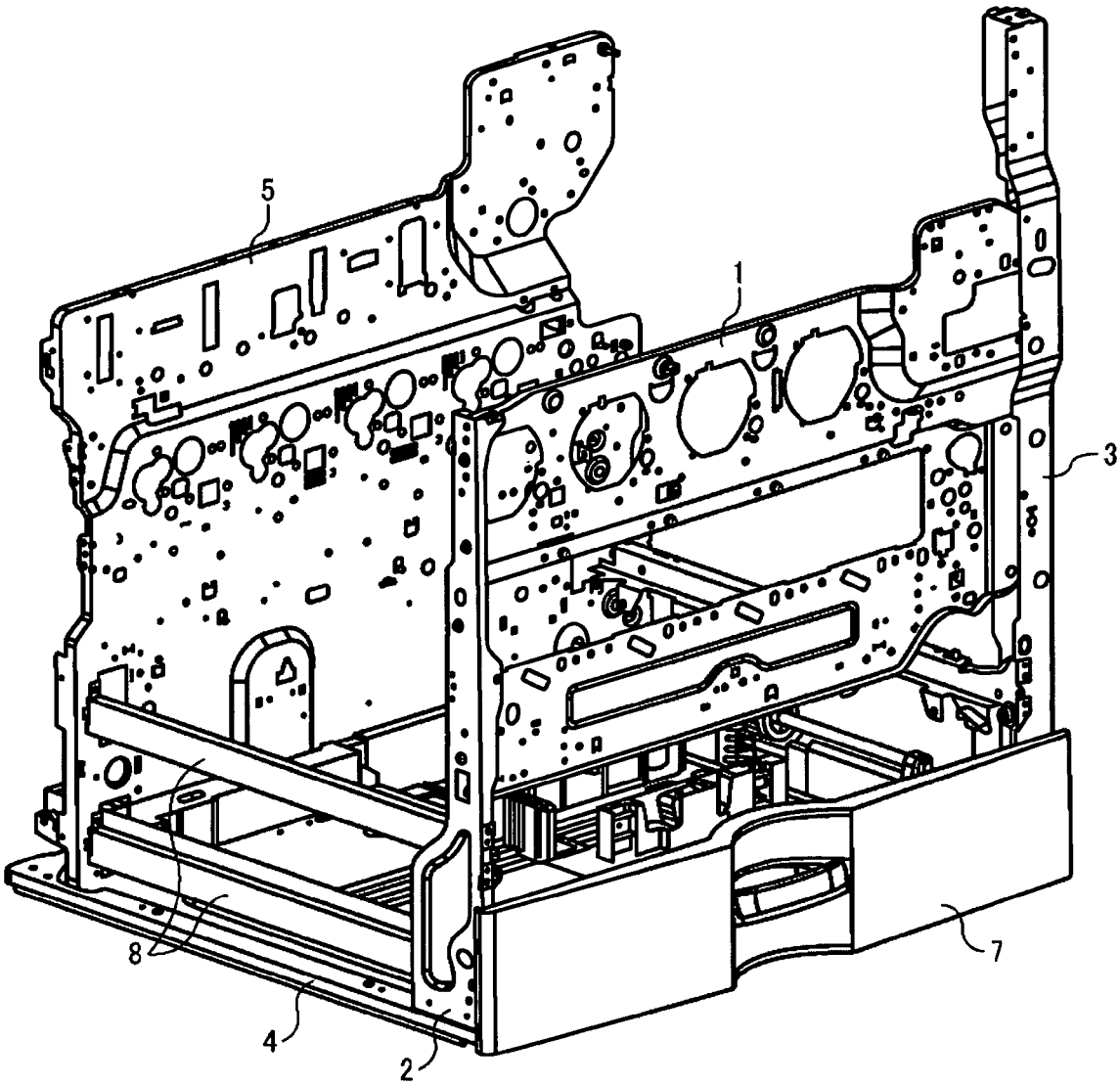
FIG. 8 illustrates a schematic perspective view of a sheet tray, positioned at a given position precisely using a front side of the elevated supporter.

A description is now given to a configuration for positioning a sheet tray precisely at a given position of a front side of the elevated supporters 2 and 3 with reference to FIGS. 7 and 8. As shown in FIG. 7, the second elevated supporter 3 may be provided with tray positioning holes 13 and 14 at a front side of the second elevated supporter 3, wherein the second elevated supporter 3 may be precisely positioned in the frame as above described. FIG. 8 shows a condition that a sheet tray 7 is fitted in a lower part (e.g., second stage for sheet tray) of the frame. A positioning member projected from the sheet tray 7 may be engaged to the tray positioning hole 14, by which the sheet tray 7 can be positioned at a given position precisely, and a front side of the sheet tray 7 can be preferably set in a given position relative to the front side of image forming apparatus. Similarly, as for an upper part (e.g., first stage for sheet tray) of the frame, the sheet tray 7 can be positioned at a given position precisely by engaging a positioning member projected from the sheet tray 7 to the tray positioning hole 13. With such a configuration, sheet(s) can be transported reliably from the sheet tray 7 set in the image forming apparatus. In other words, sheet transport performance can be enhanced. Such a configuration can be similarly applied to other configurations of image forming apparatus, which include only one sheet tray, or a number of sheet trays (e.g., three or more sheet trays).

As such, the sheet feed unit can be precisely positioned at a given position relative to the elevated supporters 2 and 3 directly. Accordingly, an additional front plate may not be required to position a sheet feed unit precisely in the frame. Therefore, a size of the front member 1 relative to the frame as whole can be reduced, by which the front member 1 can be manufactured with enhanced precision, and a cost reduction can be achieved.

Figure 9:
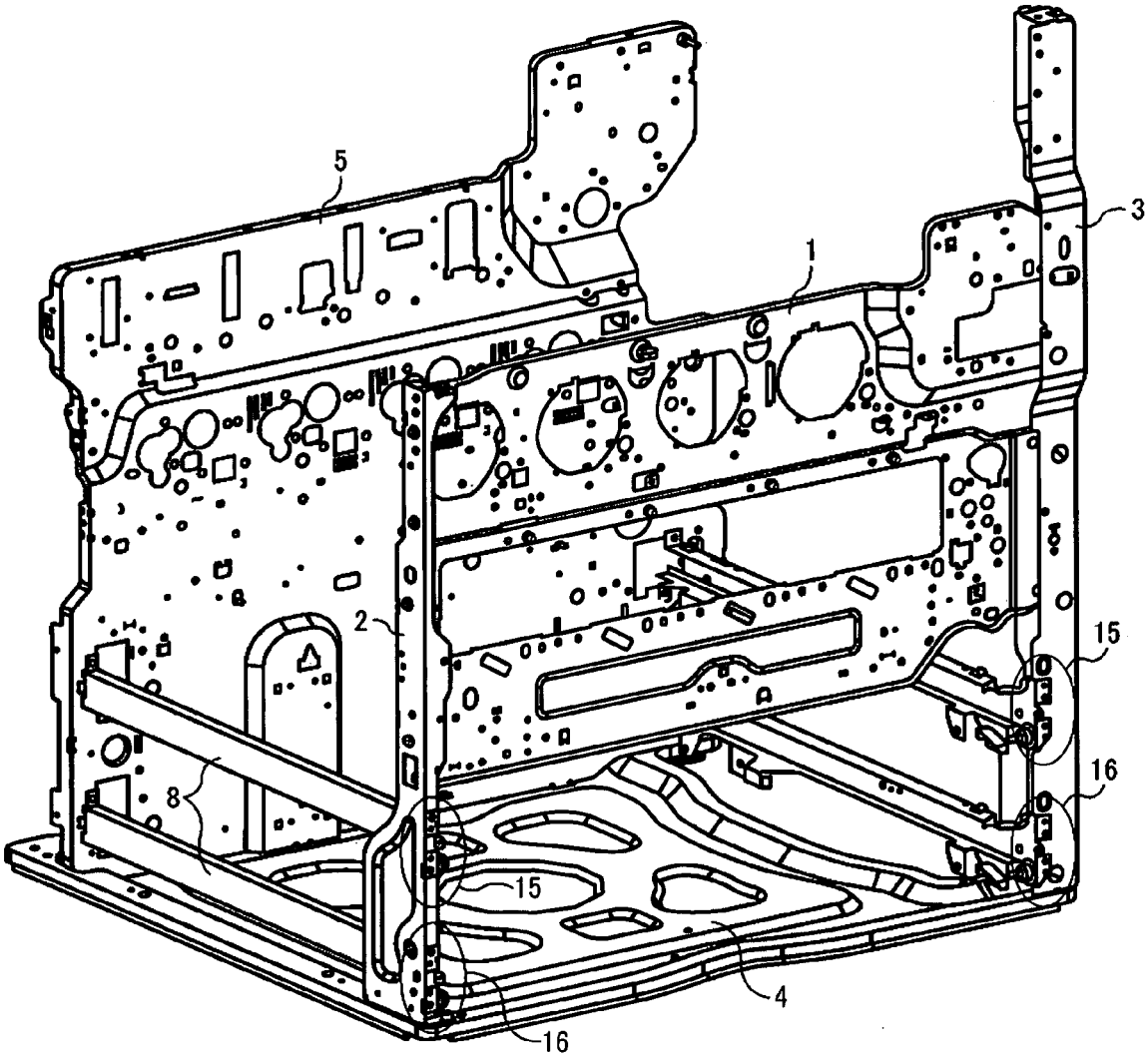
FIG. 9 illustrates a schematic perspective view of a rail, positioned at a given position precisely using a front side of the elevated supporter.

Further, as shown in FIG. 9, the elevated supporters 2 and 3 may be provided with positioning members 15 and 16 to which a rail 8 can be fitted. The sheet tray 7 may be slidably fitted on the rail 8. The positioning members 15 and 16 may be a projection or a hole, for example. The rail 8 can be engaged and fixed to the positioning members 15 and 16 provided at the front side of the elevated supporters 2 and 3, wherein the elevated supporters 2 and 3 may be precisely positioned in the frame. When the sheet tray 7 is pulled out from the image forming apparatus, a front portion of the rail 8 may receive a greater load. With the above-described configuration, the elevated supporters 2 and 3 having a good level of stiffness can effectively support the front portion of the rail 8.

In addition to the above described exterior cover or the sheet tray 7, other parts or units which need to be precisely positioned in the frame can be precisely positioned at a given position in the frame using the lateral face, the front face, and the rear face of the elevated supporters 2 and 3.

Further, in an exemplary embodiment, a load applied to the front side of the image forming apparatus in a substantially vertical direction may be concentrated to a footprint of the elevated supporters 2 and 3. Accordingly, it may be desirable to receive a load effectively, and to secure stiffness of the front side of the frame, and to secure stiffness of the frame as a whole. Accordingly, as shown in FIG. 3, an elastic member 10 may be provided at a given portion of the base member 4, which corresponds to an open portion of the U-shaped form of the elevated supporters 2 and 3 (see an arrow portion C in FIG. 3). The elastic member 10 may be made of resin material, rubber, or the like, for example, but not limited thereto.

Figure 10:
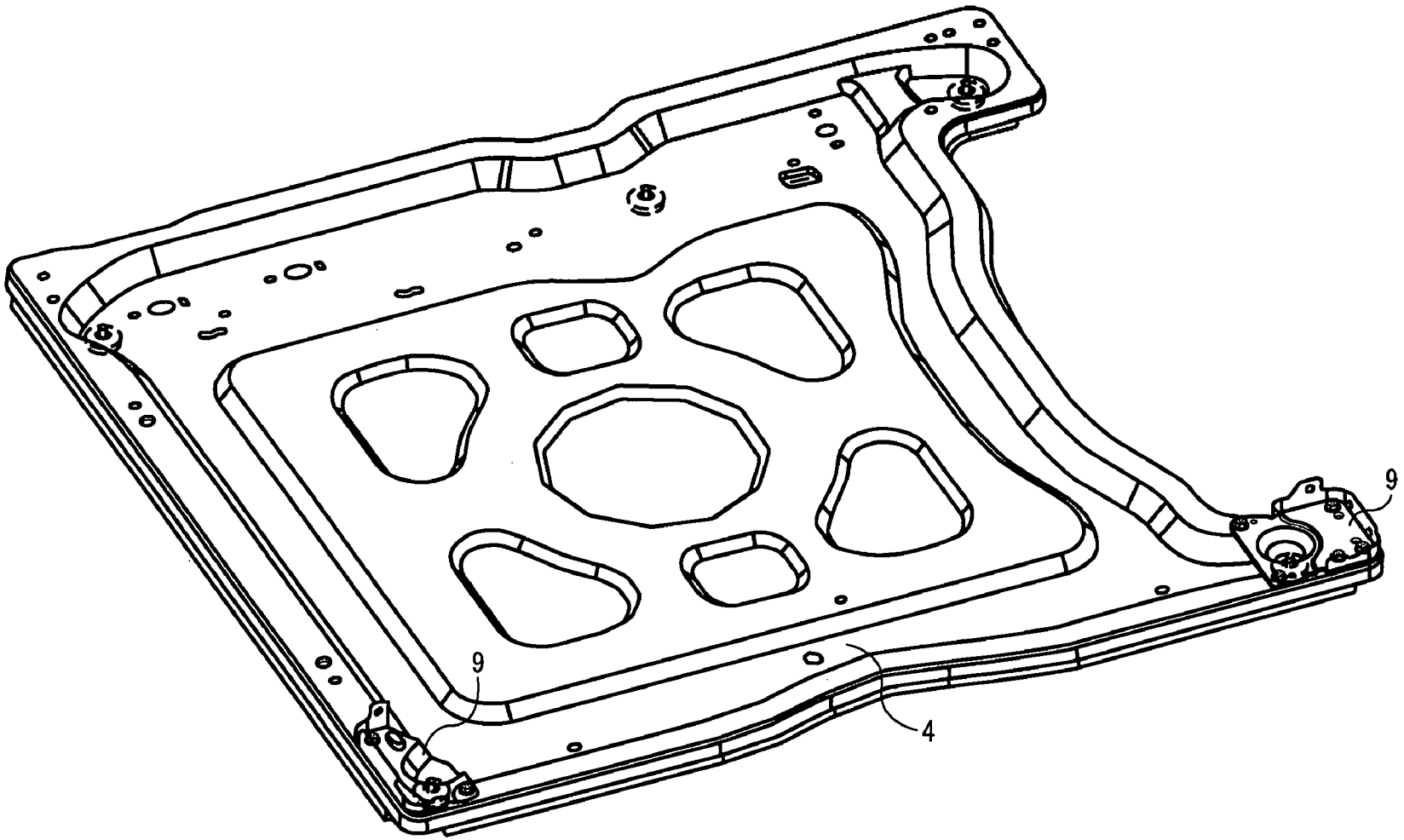
FIG. 10 illustrates a schematic configuration of a base plate having a supporter-fixing member.

Further, as shown in FIG. 10, a supporter-fixing member 9 may be provided to the base member 4 where the elevated supporters 2 and 3 land on the base member 4. The supporter-fixing member 9 may have a flange on its circumference, wherein the flange may be prepared by a drawing process, for example. Such flanged portion may be contacted to the elevated supporters 2 and 3 to fix the elevated supporters 2 and 3 to the supporter-fixing member 9, wherein the supporter-fixing member 9 may be disposed with a plurality of such faces contactable to the elevated supporters 2 and 3. The flange may be cut or may not be cut in the middle of the flange.

Figure 11:
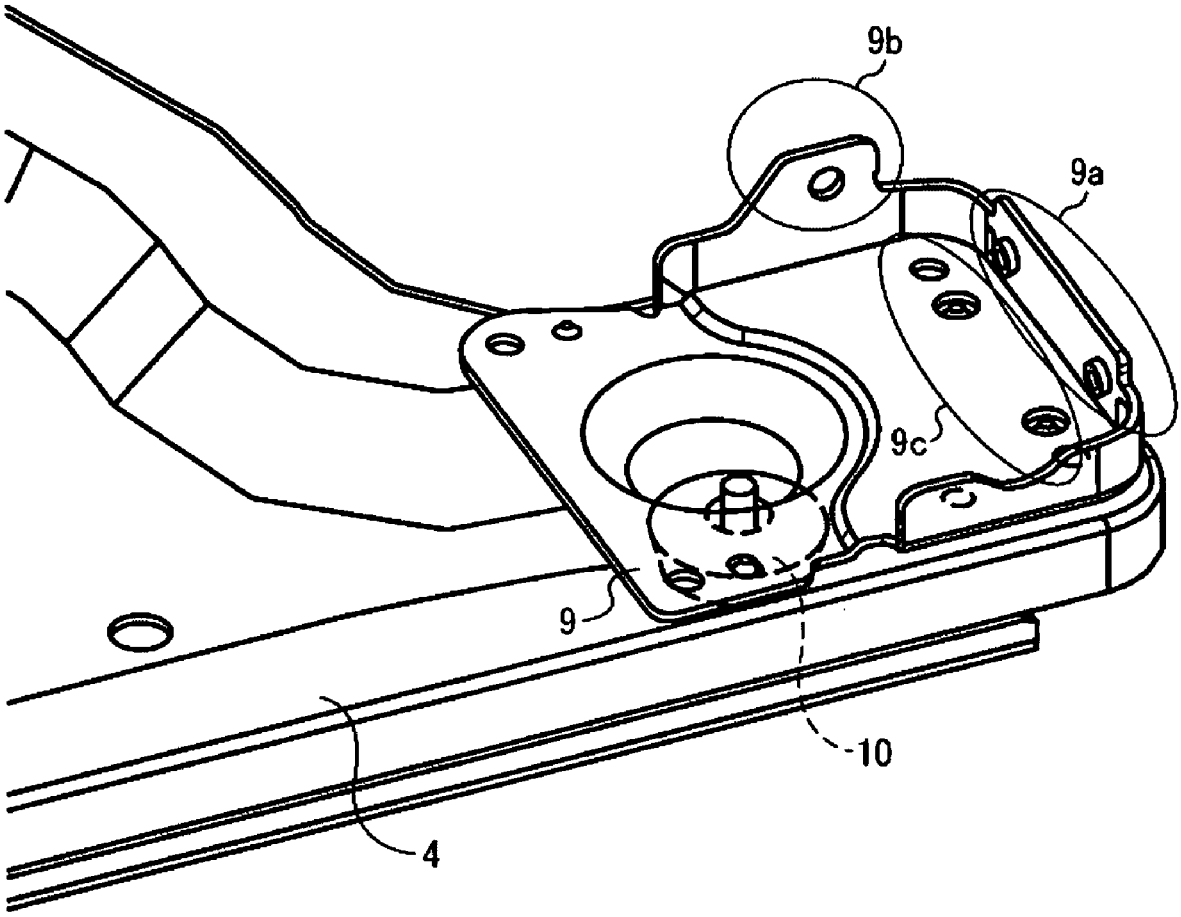
FIG. 11 illustrates an expanded view of the supporter-fixing member.
Figure 12:
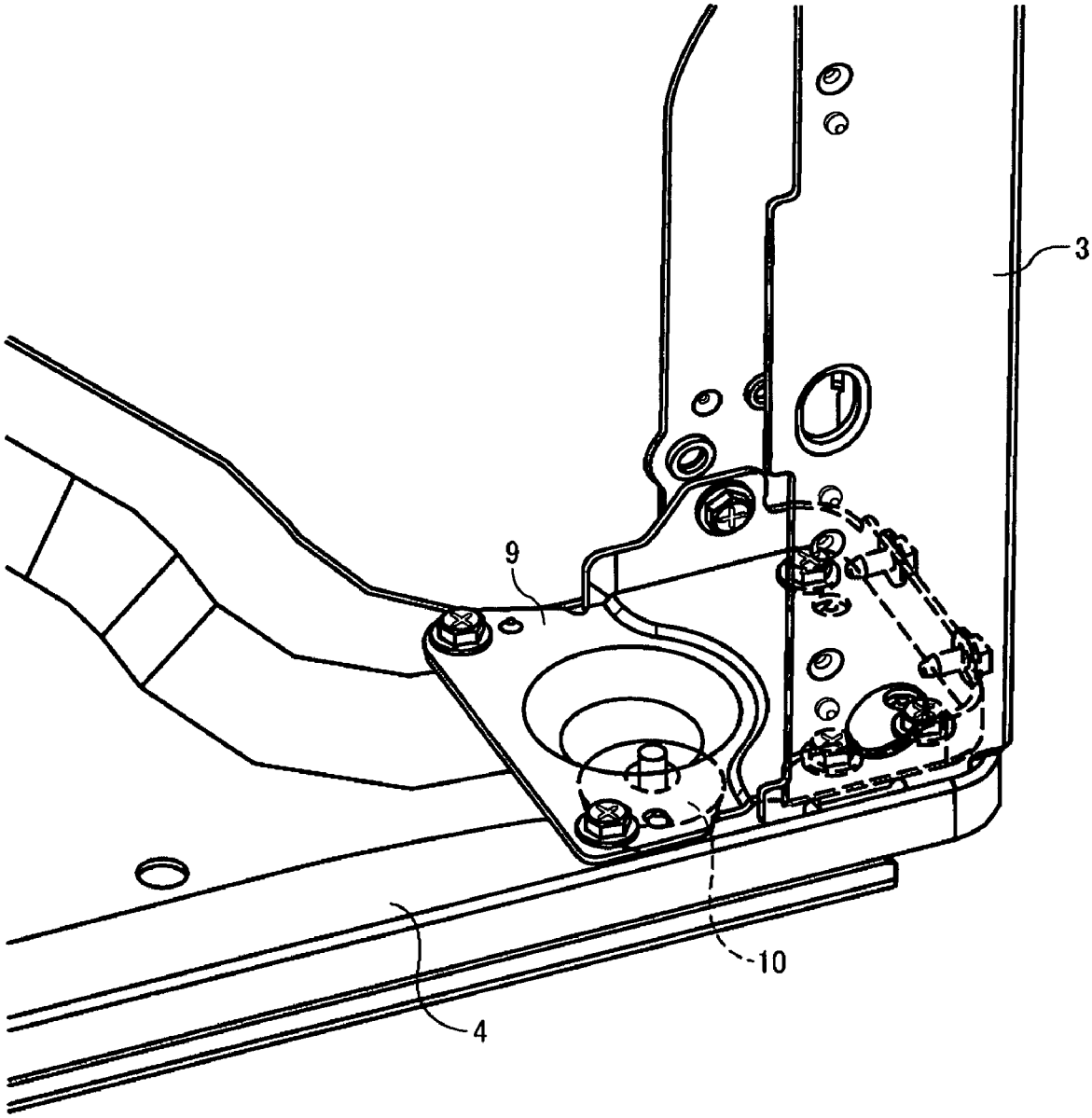
FIG. 12 illustrates a condition that the elevated supporter is fixed to the base place using the supporter-fixing member.

FIG. 11 illustrates an expanded view of the supporter-fixing member 9, which is used to fix elevated supporters 2 and 3 on the base member 4. Further, FIG. 12 illustrates an expanded view of the second elevated supporter 3 fixed on the base member 4 at the supporter-fixing member 9. As shown in FIGS. 11 and 12, the second elevated supporter 3 may be fixed to the supporter-fixing member 9 at a lateral face 9*a* and a rear face 9*b* of the supporter-fixing member 9; and the second elevated supporter 3, the supporter-fixing member 9, and the base member 4 may be fixed at a bottom face 9*c* of the supporter-fixing member 9. As such, the second elevated supporter 3 can be fixed to the base member 4 using the supporter-fixing member 9 having a plurality of faces (termed as "fixing face") used for fixing the second elevated supporter 3 to the base member 4. Accordingly, the second elevated supporter 3 may be fixed to the base member 4 by selecting fixing face(s) from the plurality of fixing faces. FIG. 12 shows one example how to fix the second elevated supporter 3 to the base member 4. By fixing the second elevated supporter 3 to the base member 4 as such, stiffness of the front member 1, the second elevated supporter 3, the base member 4, and the front side of the frame can be kept at a given preferable level. The first elevated supporter 2 can be fixed to the supporter-fixing member 9 as similar to the second elevated supporter 3 shown in FIG. 12. Further, the elevated supporters 2 and 3 can be fixed to the supporter-fixing member 9 using a screw, a rivet, and welding, but not limited these.

Further, as shown in FIGS. 10, 11 and 12, the elastic member 10 may be engaged to a hole formed in the base member 4. If the elastic member 10 has a lower flame resistance, the hole of the base member 4 may be assumed as an open portion. Then, the base member 4 cannot be used as a fire-resisting enclosure, which may be required by a safety regulation. Accordingly, an upper part of the hole of the base member 4 may need to be covered with a fire-resisting enclosure. In an exemplary embodiment, the supporter-fixing member 9 can be used as the fire-resisting enclosure to cover the hole of the base member 4 without adding other parts. Accordingly, safety (e.g., fire-proof) of the apparatus can be enhanced with a lower cost configuration.

Figure 13:
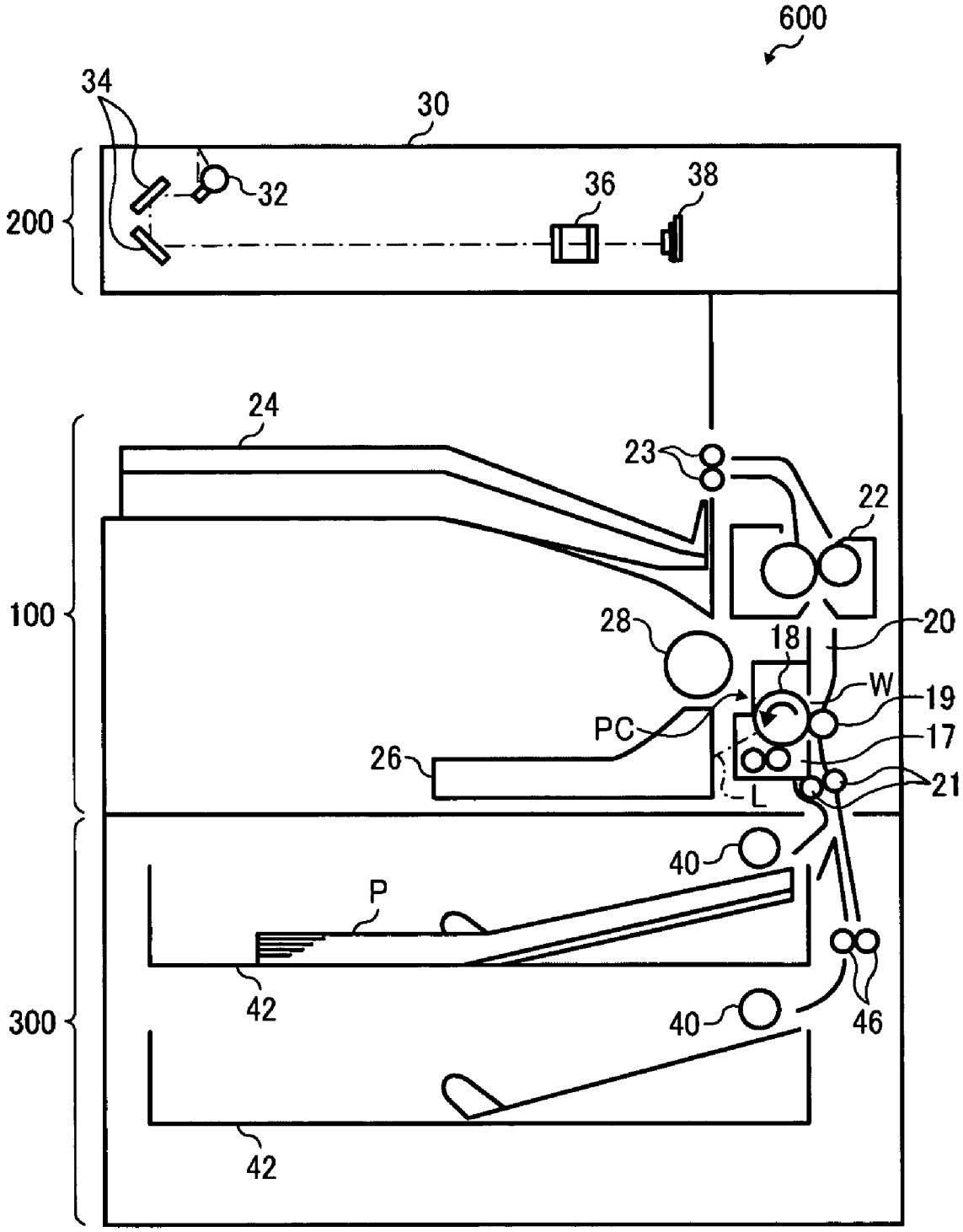
FIG. 13 illustrates a schematic configuration of an image forming apparatus using the frame of FIG. 1.

A description is now given to an image forming apparatus using the above-described frame, such as for example a copier, with reference to FIG. 13 illustrating a schematic configuration of an image forming apparatus 600. The image forming apparatus 600 may include an image forming unit 100, an image scanning unit 200, and a sheet feed unit 300, for example. In the image forming unit 100, an image is formed on an image bearing member. The image scanning unit 200, disposed over the image forming unit 100, scans document image. The sheet feed unit 300, disposed under the image forming unit 100, feeds a recording medium.

The image forming unit 100 may include a process cartridge PC, wherein the process cartridge PC may include an image bearing member 18, a charge unit, a development unit, and a cleaning unit, all of which may be encased in a cartridge case 17, for example. The image bearing member 18 having a drum shape may contact a transfer unit 19 having a roller shape through a transfer window of the process cartridge PC.

In the image forming unit 100, the image bearing member 18 may contact the transfer unit 19 at a transfer position, and a sheet transport path 20 is extended to the transfer position from a lower portion of the image forming apparatus 600.

In the sheet transport path 20, a registration roller 21 is disposed at an entry side of the transfer position, and a fixing unit 22 and an ejection roller 23 are disposed at an exit side of the transfer position. The ejection roller 23 ejects and stacks a recording medium having printed image to a stack space 24, which may be provided between the image forming unit 100 and the image scanning unit 200.

As shown in FIG. 13, the image forming unit 100 may further include an optical writing unit 26, and a toner bottle 28 to supply toner to a development unit in the process cartridge PC.

The image scanning unit 200 may include a contact glass 30, a light source 32, a plurality of mirrors 34, a focus lens 36, an image sensor 38, for example. The image sensor 38 may be a CCD (charge coupled device), for example. The light source 32 can be moved along and under the contact glass 30. A light beam emitted from the light source 32 reflects on a document placed on the contact glass 30, and a reflected light beam is reflected by the mirrors 34 and focused by the focus lens 36 to the image sensor 38 to read document image.

In the image forming apparatus 600, the stack space 24 is provided on the image forming unit 100, and the image scanning unit 200 is provided over the image forming unit 100. The image scanning unit 200 may be provided with an operation panel having a display on its front side, and an automatic document feeder may be provided over the image scanning unit 200.

With such a configuration, the stack space 24 may not be projected outside the image forming apparatus 600, by which a footprint of the image forming apparatus 600 can be set smaller. Further, to easily pick up a recording medium P having printed image, the stack space 24 may be set as an open space having no walls at the front and left side of the image forming unit 100. The image scanning unit 200 may be supported by three portions extended from the image forming unit 100 while disposing the stack space 24 between the image scanning unit 200 and the image forming unit 100.

When to copy an image using the image forming apparatus 600, a document is set on the automatic document feeder, or a document is directly set on the contact glass 30 of the image scanning unit 200 by opening the automatic document feeder. Then, a start button on the operation panel is pressed to activate the automatic document feeder, by which the image scanning unit 200 starts to scan document image information.

Simultaneously, the image bearing member 18 may be rotated in a counter-clockwise direction, and the surface of image bearing member 18 is uniformly charged by the charge unit. Based on the image information scanned by the image scanning unit 200, the optical writing unit 26 emits a laser beam L to the image bearing member 18 to form an electrostatic latent image on the image bearing member 18. Then, the development unit develops the electrostatic latent image as a toner image on the image bearing member 18.

Further, a feed roller 40 may be rotated to feed the recording medium P from one of sheet cassettes 42 provided in the sheet feed unit 300 to a transport path, and a transport roller 46 transports the recording medium P through the transport path and the sheet transport path 20 in the image forming unit 100. Then, the registration roller 21 stops the recording medium P.

The registration roller 21 can be rotated at a given timing when the toner image is formed on the image bearing member 18, and may guide the recording medium P to the transfer position in the cartridge case 17. Then the toner image on the image bearing member 18 can be transferred to the recording medium P with an effect of the transfer unit 19.

After such transfer process, the recording medium P is fed to the fixing unit 22 to fix the toner image on the recording medium P by applying heat and pressure. Then, the ejection roller 23 ejects the recording medium P to the stack space 24. After such transfer process, the cleaning unit cleans a surface of the image bearing member 18 to remove residual toner.

In the image forming apparatus 600 having the above-described frame, the image forming unit 100 can be precisely positioned at a given position with a reduced cost. Further, even if the image forming apparatus 600 is installed on a surface that is not flat or level, enhanced stiffness of the front side of the frame and enhanced shape retentiveness of the frame can be realized using the above-described frame. With such a configuration, a higher quality image can be produced while reducing deterioration of image quality. Such deterioration of image quality may appear as follows. For example, two parallel lines in image may be undesirably produced as unparallel lines; a straight line in image may be undesirably produced as curved line; a right angle in image may be undesirably deviated from the right angle; and two color images may not be superimposed one to another correctly.

In an exemplary embodiment, a sheet feed unit can be positioned at a given position using the elevated supporter of the above-described frame. Such positioning of the sheet feed unit may be less precise compared to a configuration using a conventional front plate, which may have a relatively greater size. However, because the registration roller 21 of the image forming unit can be precisely positioned at a given position using the above-described frame, an orientation of the recording medium P can be corrected precisely. Therefore, sheet transportation can be conducted reliably.

As above described, the frame according to an exemplary embodiment may include the front member 1, the rear member 5, the base member 4, and the elevated supporters 2 and 3, for example. The front member 1 and the rear member 5 may support an image forming unit. The base member 4 may support the rear member 5. The elevated supporters 2 and 3 may face each other by facing an open portion of the U-shape each other.

The first elevated supporter 2 and the second elevated supporter 3 may support the front member 1 while positioning the both lateral rim portions of the front member 1 at a given position precisely. The elevated supporters 2 and 3 fixed to the base member 4 in a direction perpendicular to the base member 4 can be used to position the image forming unit at a given position precisely. By using such elevated supporters 2 and 3, a rim portion of the front member 1 can be abutted against and fixed to the first internal face, which is disposed inside the U-shaped form of the elevated supporters 2 and 3 parallel to a transversal direction of the front member 1, and another rim portion of the front member 1 can be abutted against and fixed to the second internal face inside the U-shaped, which is perpendicular to the first internal face, by which the front member 1 can be positioned at a given position precisely.

On the contrary, if the elevated supporters 2 and 3 may not face each other by facing an open portion of the U-shape each other, or if such elevated supporters may have a hollow square shape in its cross section, the front member 1 can be abutted against and fixed only to an outer face of elevated supporter from one direction. Such configuration may not position the front member 1 at a given position precisely. Accordingly, by supporting the both lateral rim portions of the front member 1, which supports the image forming unit, by the elevated supporters 2 and 3, the image forming unit can be positioned at a given position precisely. Specifically, the elevated supporters 2 and 3 can support and position the front member 1 using the first internal face and the second internal face of the elevated supporters 2 and 3.

Further, the front member 1 may be indirectly fixed with the base member 4 via the elevated supporters 2 and 3, which means that the front member 1 is not extended and directly fixed to the base member 4. Accordingly, the front member 1 can be reduced in size while enhancing stiffness of the front member 1. With such a configuration, the frame may have a good level of shape retentiveness. Further, because the front member 1 can be reduced in size, part-dimension precision for the front member 1 can be enhanced, and a cost reduction can be achieved.

Further, a conventional elevated supporter having a hollow square shape may need a welding process for closing a gap of the elevated supporter, and the elevated supporter having the hollow square shape may further need a welding process and a joint member to fix the elevated supporter to another frame. On the contrary, the elevated supporters 2 and 3 having the U-shaped form can be manufactured without such welding process for gap closing and a welding process and a joint member required for fixing the elevated supporter to another frame. Accordingly, the elevated supporters 2 and 3 can achieve cost reduction.

Further, the front member 1 may be fixed to the elevated supporters 2 and 3 from two directions. For example, the elevated supporters 2 and 3 can support the front member 1 from the rear side direction and the lateral side direction as shown in FIG. 6. Specifically, a lateral face of the second elevated supporter 3 is fixed to a lateral portion of the flange 1*a* of the front member 1. Accordingly, the front member 1 and the elevated supporters 2 and 3 can be assembled and integrated as a substantially one single structure, by which stiffness of the frame can be further enhanced.

Further, the front member 1 may include the flange 1*a* formed along the circumference of the front member 1 to enhance stiffness of the front member 1. Then, a lateral face of the elevated supporters 2, perpendicular to the front member 1, can be fixed to a lateral portion of the flange 1*a* of the front member 1. Such configuration can further enhance stiffness of the frame.

Further, as shown in FIG. 3, the elevated supporters 2 and 3 may be formed to have different physical dimensions along the elevated supporters 2 and 3. For example, an lower portion "b" of the elevated supporters 2 and 3, near which the elevated supporters 2 and 3 are fixed to the base member 4, may be set greater than an upper portion "a" of the elevated supporters 2 and 3 near which the elevated supporters 2 and 3 are fixed with the front member 1. Accordingly, the lower portion "b" may have a greater cross-sectional area than the upper portion "a."

Accordingly, a lower part of the elevated supporters 2 and 3 may have a greater stiffness compared to an upper part of the elevated supporters 2 and 3, by which the stiffness at the front side of the frame and the stiffness of the whole frame can be effectively attained.

Further, the elevated supporters 2 and 3 having the U-shaped form can encase the front member 1 in a portion of the U-shaped form. Accordingly, the flange 1*a* extending along the circumference of the front member 1 may not need to be cut in a middle of the flange 1*a*, by which enhanced stiffness of the frame can be maintained.

Further, the frame may include the arm 6, which can be pulled out from the frame when to move or transport the apparatus from one place to another. FIG. 7 illustrates a front view of the frame, in which, the arm 6 can be pulled out from a lateral side of the elevated supporters 2 and 3 when to use the arm 6. The arm 6 is disposed in the frame in a given configuration so that a given portion P (see FIG. 7) of the elevated supporters 2 and 3 can be used as a supporting point of the arm 6 when the arm 6 is pulled out and the apparatus is lifted by applying an upward load to a grip portion of the arm 6 (a point of force). Similarly, the given portion P (see FIG. 7) of the elevated supporters 2 and 3 can be used as the supporting point of the arm 6 when the arm 6 is pulled out and a downward load is applied to the point of force. As such, the load applied to the supporting point of the arm 6 can be received by a given portion of the elevated supporters 2 and 3 by which the arm 6 can be used safely even if some given load is applied to the arm 6.

Further, the elevated supporters 2 and 3 may be used as the precise positioning member for positioning units precisely as above described. Such elevated supporters 2 and 3 can position given parts or units at a given position precisely, in which the elevated supporters 2 and 3 may contact the given parts or units directly.

Further, by positioning the exterior cover precisely at a lateral face of elevated supporters 2 and 3, the exterior cover can be positioned at a given position relative to the frame precisely, by which an external appearance of image forming apparatus can be enhanced.

Further, by positioning the sheet tray 7 at a front side of the elevated supporters 2 and 3 precisely, the sheet tray 7 can be precisely positioned at a given position relative to the frame. With such a configuration, sheets can be transported reliably from the sheet tray 7 set in the image forming apparatus. In other words, sheet transport performance can be enhanced.

Further, the elevated supporters 2 and 3 may be provided with the positioning members 15 and 16 to which the rail 8 can be fitted. The sheet tray 7 may be slidably fitted on the rail 8. The positioning members 15 and 16 may be a projection or a hole, for example. The rail 8 can be engaged and fixed to the positioning members 15 and 16 provided at the front side of the elevated supporters 2 and 3, by which the rail 8 can be positioned at a given position relative to the frame precisely. With such a configuration, sheets can be transported reliably from the sheet tray 7 set in the image forming apparatus. In other words, sheet transport performance can be enhanced.

Further, when the sheet tray 7 is pulled out from the image forming apparatus, a front portion of the rail 8 may receive a greater load. With the above-described configuration, the elevated supporters 2 and 3 having a good level of stiffness can effectively support the front portion of the rail 8.

Further, in an exemplary embodiment, a load applied to the front side of the image forming apparatus in a substantially vertical direction may be concentrated to a footprint of the elevated supporters 2 and 3. Accordingly, as shown in FIG. 3, the elastic member 10 may be provided at a given portion of the base member 4, which corresponds to an open portion of the U-shaped form of the elevated supporters 2 and 3 (see an arrow portion C in FIG. 3). With such a configuration, a load can be received effectively, and stiffness of the front side of the frame can be desirably secured.

Further, the supporter-fixing member 9 may be provided to the base member 4 where the elevated supporters 2 and 3 land on the base member 4. The supporter-fixing member 9 may include a plurality of faces contactable to the elevated supporters 2 and 3. The second elevated supporter 3 can be fixed to the base member 4 using the supporter-fixing member 9 having a plurality of faces (termed as fixing face) used for fixing the second elevated supporter 3 to the base member 4. Accordingly, the second elevated supporter 3 may be fixed to the base member 4 by selecting fixing face(s) from the plurality of fixing faces. By fixing the second elevated supporter 3 to the base member 4 as such, stiffness of the front member 1, the second elevated supporter 3, the base member 4, and the front side of the frame can be kept at a given level.

Further, the elastic member 10 may be engaged to a hole formed in the base member 4. If the elastic member 10 has a lower flame resistance, the hole of the base member 4 may be assumed as an open portion. Then, the base member 4 cannot be used as a fire-resisting enclosure, which may be required by a safety regulation. Accordingly, an upper part of the hole of the base member 4 needs to be covered with a fire-resisting enclosure. The supporter-fixing member 9 can be used as the fire-resisting enclosure to cover the hole of the base member 4 without adding other parts. Accordingly, safety (e.g., fireproof) of the apparatus can be enhanced with a lower cost configuration.

Further, in the image forming apparatus 600 (e.g., copier) having the above-described frame, the image forming unit 100 can be positioned at a given position precisely with a reduced cost. Further, even if the image forming apparatus 600 is installed on a surface that is not flat or level, enhanced stiffness of the front side of the frame and enhanced shape retentiveness of the frame can be realized using the above described frame. With such a configuration, a higher quality image can be produced while reducing deterioration of image quality. Such deterioration of image quality may appear as follows. For example, two parallel lines in image may be undesirably produced as unparallel lines; a straight line in image may be undesirably produced as curved line; a right angle in image may be undesirably deviated from the right angle; and two color images may not be superimposed one to another correctly.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. A frame for an image forming apparatus including at least one functional unit, comprising:

a front member that supports the at least one functional unit;

a rear member that supports the at least one functional unit;

a base member; and a pair of elevated supporters, fixed at least to the base member, each of the elevated supporters having a U-shaped cross-section, and the elevated supporters spaced a given distance apart and disposed facing an open part of the U-shaped form of the pair of elevated supporters, the front member being indirectly fixed to the base member via the elevated supporters and positioning the at least one functional unit at a given position, the base member supports at least the elevated supporters, and the elevated supporters includes a U-shaped supporter, whereby a portion of the U-shaped supporters, which is parallel to the front member, is contacted and fixed with the front member.

2. A frame for an image forming apparatus including at least one functional unit, comprising:

a front member that supports the at least one functional unit;

a rear member that supports the at least one functional unit;

a base member; and a pair of elevated supporters, fixed at least to the base member, each of the elevated supporters having a U-shaped cross-section, and the elevated supporters spaced a given distance apart and disposed facing an open part of the U-shaped form of the pair of elevated supporters, the front member being indirectly fixed to the base member via the elevated supporters and positioning the at least one functional unit at a given position, wherein lateral rim portions of the front member include a first rim portion and a second rim portion perpendicular to the first rim portion, the first rim portion is abutted against and fixed to a first internal face disposed inside the U-shaped elevated supporters, and the second rim portion is abutted against and fixed to a second internal face inside the U-shaped elevated supporters perpendicular to the first internal face.

3. The frame according to claim 2, wherein the front member includes a flange extending along its circumference, and a lateral portion of the flange is fixed to the second internal face of the elevated supporters.

4. The frame according to claim 3, wherein a cross-sectional area of a first portion of the elevated supporter near which the elevated supporter is fixed to the base member is set greater than a cross-sectional area of a second portion of the elevated supporter near which the elevated supporter is fixed with the front member, wherein the first portion and the second portion have the U-shaped form as a cross-section form.

5. The frame according to claim 4, wherein the elevated supporters encase the lateral rim portions of the front member.

6. The frame according to claim 5, further comprising an arm withdrawable from a lateral face of the elevated supporters, wherein the lateral face of the elevated supporters supports the arm when the arm is withdrawn and subjected to a load.

7. The frame according to claim 5, wherein the elevated supporters include a positioning portion disposed at a lateral side of the elevated supporter to position an exterior cover at a given position of the elevated supporters.

8. The frame according to claim 5, wherein the elevated supporters include a positioning portion to position a sheet tray at a given position of a front side of the elevated supporters.

9. The frame according to claim 5, wherein the elevated supporters include a positioning portion to position a rail at a given position of a front side of the elevated supporters, the sheet tray is slidably fitted on the rail.

10. The frame according to claim 5, wherein the base member is provided with an elastic member at a position corresponding to an open part of the U-shaped elevated supporters.

11. The frame according to claim 5, wherein the base member includes a supporter-fixing member to which the elevated supporter is fixed.

12. The frame according to claim 11, wherein the base member includes a hole engaged by the elastic member, and the supporter-fixing member covers the hole.

13. An image forming apparatus, comprising:

an image forming unit to form a toner image; and a frame to support the image forming unit at a given position, the frame including:

a front member that supports the image forming unit;

a rear member that supports the image forming unit;

a base member; and a pair of elevated supporters, fixed at least to the base member, each of the elevated supporters having a U-shaped cross-section, and the elevated supporters spaced a given distance apart and disposed facing an open part of the U-shaped form of the pair of elevated supporters, the front member being indirectly fixed to the base member via the elevated supporters and positioning the image forming unit at a given position, the base member supports at least the elevated supporters, and the elevated supporters includes a U-shaped supporter, whereby a portion of the U-shaped supporters, which is parallel to the front member, is contacted and fixed with the front member.

* * * * *